US010044111B2

(12) United States Patent
Murdock et al.

(10) Patent No.: US 10,044,111 B2
(45) Date of Patent: Aug. 7, 2018

(54) WIDEBAND DUAL-POLARIZED PATCH ANTENNA

(71) Applicant: Phazr, Inc., Allen, TX (US)

(72) Inventors: James Murdock, Allen, TX (US); Hamidreza Memarzadeh, Allen, TX (US); Farooq Khan, Allen, TX (US)

(73) Assignee: Phazr, Inc., Allen, TX (US)

( * ) Notice: Subject to any disclaimer, the term of this patent is extended or adjusted under 35 U.S.C. 154(b) by 85 days.

(21) Appl. No.: 15/289,556

(22) Filed: Oct. 10, 2016

(65) Prior Publication Data

US 2018/0102594 A1 Apr. 12, 2018

(51) Int. Cl.

| | |
|---|---|
| ***H01Q 9/04*** | (2006.01) |
| ***H01Q 21/06*** | (2006.01) |
| ***H01Q 1/48*** | (2006.01) |
| ***H01Q 21/00*** | (2006.01) |
| ***H01Q 1/38*** | (2006.01) |
| ***H01Q 5/307*** | (2015.01) |

(52) U.S. Cl.

CPC ..... *H01Q 21/065* (2013.01); *H01Q 1/38* (2013.01); *H01Q 1/48* (2013.01); *H01Q 5/307* (2015.01); *H01Q 9/045* (2013.01); *H01Q 9/0414* (2013.01); *H01Q 9/0421* (2013.01); *H01Q 21/0068* (2013.01)

(58) Field of Classification Search

CPC .... H01Q 9/0414; H01Q 9/0421; H01Q 9/045; H01Q 5/307

See application file for complete search history.

(56) References Cited

U.S. PATENT DOCUMENTS

| | | | | | |
|---|---|---|---|---|---|
| 4,903,033 | A * | 2/1990 | Tsao | H01Q 9/0414 | 343/700 MS |
| 5,223,848 | A * | 6/1993 | Rammos | H01Q 9/0407 | 343/700 MS |
| 5,382,959 | A * | 1/1995 | Pett | H01Q 21/065 | 343/700 MS |
| 6,002,370 | A * | 12/1999 | Mckinnon | H01Q 1/38 | 343/700 MS |
| 2015/0333407 | A1* | 11/2015 | Yamagajo | H01Q 9/0414 | 343/905 |
| 2016/0261039 | A1* | 9/2016 | Parsche | H01Q 1/526 | |

* cited by examiner

*Primary Examiner* — Hoang Nguyen
(74) *Attorney, Agent, or Firm* — Michael A. Rahman

(57) ABSTRACT

A wideband dual-polarized patch antenna includes a ground plane layer and a first dielectric substrate layer disposed on the ground plane layer. A first radiator patch is disposed on the first dielectric substrate layer and a second dielectric substrate layer is disposed on the first radiator patch. A second radiator patch is disposed on the second dielectric substrate layer and a third dielectric substrate layer is disposed on the second radiator patch. A third radiator patch is disposed on the third dielectric substrate layer. The patch antenna also includes first and second feed lines electrically connected to the radiator patches and to the ground plane. The first and second feed lines are configured to excite the antenna in two separate directions to cause orthogonal dual-polarization. The radiator patches and the ground plane are comprised of a conductive material.

25 Claims, 10 Drawing Sheets

WIDEBAND DUAL-POLARIZED PATCH ANTENNA

TECHNICAL FIELD

This application relates generally to wireless communications, and more specifically to wideband dual-polarized patch antennas.

BACKGROUND

Patch antennas are increasingly being used in wireless applications. Due to a patch antenna's low profile, it can easily be made to conform to a host surface. Also, the patch antenna can have many geometries, such as, for example, circular or rectangular geometry. A patch antenna includes a base conductor layer (the ground plane), a dielectric spacer (the substrate), and a signal conductor layer (the patch). A feed line (e.g., micro-strip line or coaxial line) electromagnetically connects the signal conductor layer and the ground plane to a transmitter and/or a receiver.

Conventional patch antennas, however, suffer from several disadvantages, including narrow bandwidth. Patch antennas radiate because of the fringing fields between the patch edge and the ground plane. For good performance, a thick dielectric substrate having a low dielectric constant is desirable since this provides larger bandwidth and better radiation. A patch antenna with a wide bandwidth typically has a large profile due to the height above the ground plane required to achieve this bandwidth, making a wideband patch antenna infeasible in many applications.

Recently, patch antenna arrays have been used in Wi-Fi and WiMAX applications. Array antennas offer high gain and high system capacity. However, existing patch antenna arrays have large antenna size and narrow frequency bandwidth due to restrictions in PCB substrate thickness.

In Wi-Fi and WiMAX base station applications, high gain array antennas with dual polarization are required to decrease the number of antennas and improve wireless system performance. Some array antennas utilize horizontal and vertical polarizations to achieve polarization diversity. The dual-polarized antenna can offer two transmission channels in the same frequency band. However, it is difficult to achieve wide bandwidth in dual polarized antennas.

A number of dual-polarized array antennas have been proposed for Wi-Fi and WiMAX applications. One proposed antenna array comprises two substrate layers which are separated by an air gap. The existence of an air gap between the two substrate layer causes the antenna to be less rigid and difficult to manufacture.

Another proposed antenna array comprises a single substrate layer, a radiation layer, and conical elements. An air gap exists between the conical elements and the substrate. Because of the conical elements and the air gap, the antenna is difficult to manufacture and is less rigid.

SUMMARY

Disclosed embodiments provide a wideband dual-polarized patch antenna. In one aspect, a wideband dual-polarized patch antenna includes a ground plane layer and a first dielectric substrate layer disposed on the ground plane layer. A first radiator patch is disposed on the first dielectric substrate layer and a second dielectric substrate layer is disposed on the first radiator patch. A second radiator patch is disposed on the second dielectric substrate layer and a third dielectric substrate layer is disposed on the second radiator patch. A third radiator patch is disposed on the third dielectric substrate layer.

The patch antenna also includes first and second feed lines electrically connected to the radiator patches and to the ground plane. The first and second feed lines are configured to excite the antenna in two separate directions to cause orthogonal dual-polarization. The radiator patches and the ground plane are comprised of a conductive material.

In another aspect, the first, second, third radiator patches and the ground plane are each formed on separate substrates of a multi-layer printed circuit board (PCB). The substrates are stacked substantially vertically. The first, second, third radiator patches and the ground plane are attached to the adjacent substrates without an air gap. Thus, no air gap exists between the radiator patches and the ground plane.

In another aspect, the radiator patches are sized to transmit downlink signals in the 24-60 GHz frequency band. In another aspect, the radiator patches are sized to receive uplink signals in the 5 GHz range frequency band.

In another aspect, a wideband dual-polarized patch antenna includes a multi-layer printed circuit board (PCB) comprising multiple substrates. A ground plane is disposed on a first substrate. A first radiator patch is formed on a second substrate disposed on the ground plane. A second radiator patch is formed on a third substrate disposed on the first radiator patch. A third radiator patch is formed on a fourth substrate disposed on the second radiator patch. The first, second, third radiator patches and the ground plane are attached to the adjacent substrates without an air gap. The patch antenna also includes first and second feed lines electrically connected to the radiator patches and to the ground plane. The first and second feed lines are configured to excite the antenna in two separate directions to cause orthogonal dual-polarization.

In another aspect, an array antenna system includes a plurality of patch antennas, wherein each patch antenna includes a ground plane layer and a first dielectric substrate layer disposed on the ground plane layer. A first radiator patch is disposed on the first dielectric substrate layer and a second dielectric substrate layer is disposed on the first radiator patch. A second radiator patch is disposed on the second dielectric substrate layer and a third dielectric substrate layer is disposed on the second radiator patch. A third radiator patch is disposed on the third dielectric substrate layer. The patch antenna also includes first and second feed lines electrically connected to the radiator patches and to the ground plane. The first and second feed are lines configured to excite the antenna in two separate directions to cause orthogonal dual-polarization.

BRIEF DESCRIPTION OF THE DRAWINGS

Reference is now made to the following descriptions in conjunction with the accompanying drawings, in which.

DETAILED DESCRIPTION

Figure 1:
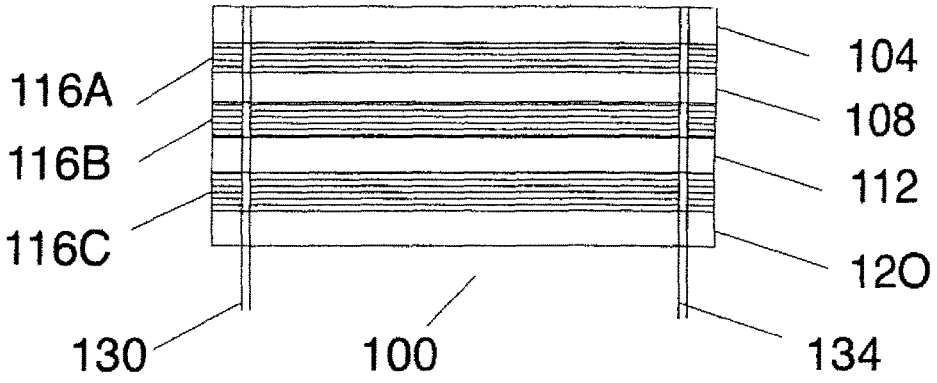
FIG. 1 illustrates a side view of a wideband dual-polarized patch antenna in accordance with disclosed embodiments.

Referring to FIG. 1, a side view of an exemplary wide-band dual-polarized antenna 100 in accordance with disclosed embodiments is shown. Antenna 100 includes radiator patches or radiator elements 104, 108, and 112. Dielectric substrate or layer 116A separates radiator patch 104 from radiator patch 108, and dielectric substrate or layer 116B separates radiator patch 108 from radiator patch 112. Antenna 100 also includes ground plane 120 which is separated from radiator patch 112 by dielectric substrate or layer 116C. Thus, radiator patches 104, 108, and 112 and ground plane 120 are stacked substantially vertically to form a stacked patch antenna.

Radiator patches 104, 108, 112 are signal conductor layers which may be comprised of a conducting material (e.g., copper or gold) used in conventional patch antennas. Similarly, ground plane 120 may be comprised of a conducting material. Dielectric substrates 116A, 116B, and 116C may be comprised of a dielectric material having low loss and small variation in permittivity with temperature.

According to disclosed embodiments, radiator patches 104, 108, and 112 and ground plane 120 are stacked substantially vertically and are attached to the adjacent substrates without any air gap. As a result, no air gap exists between the radiator patches and the ground plane.

According to principles of the invention, antenna 100 is excited separately by feed lines 130 and 134 in two directions. Feed line 130 may be a horizontal feed line and feed line 134 may be a vertical feed line. By exciting antenna 100 separately in two directions, two linear orthogonal polarizations are implemented on the radiator patches.

According to disclosed embodiments, feed lines 130 and 134 may comprise coaxial lines, microstrip lines, or wave guides which couple radiator patches 104, 108, and 112 and ground plane 120. The inner conductor of a coaxial line may extend through the dielectric substrates 116A, 116B and 116C and connect to radiator patches 104, 108, 112, while the outer conductor of a coaxial line may be connected to ground plane 120.

Although antenna 100 is illustrated in FIG. 1 as comprising three radiator patches 104, 108 and 112, some embodiments according to the principles of the invention may be implemented by stacking more than three radiator patches. Radiator patches 104, 108, and 112 may have the same size. In some embodiments, however, the radiator patches may be constructed such that their sizes vary. Thus, for example, the width of a first radiator patch may be greater than the width of a second radiator patch.

During transmission, AC current is supplied to antenna 100 via feed lines 130 and 134. In order to achieve dual polarization, AC current from signal sources (e.g., transmitters) may be supplied in two different directions via feed lines 130 and 134. The oscillating current creates an oscillating electric field and an oscillating magnetic field along the antenna elements (i.e., radiator patches and ground plane). The time-varying electric and magnetic fields radiate away from antenna 100 into the space as moving transverse electromagnetic fields. Conversely, during reception the oscillating electric and magnetic fields of an incoming radio waves create oscillating current in the antenna elements that is applied to a receiver via feed lines 130 and 134 to be amplified.

Figure 2:
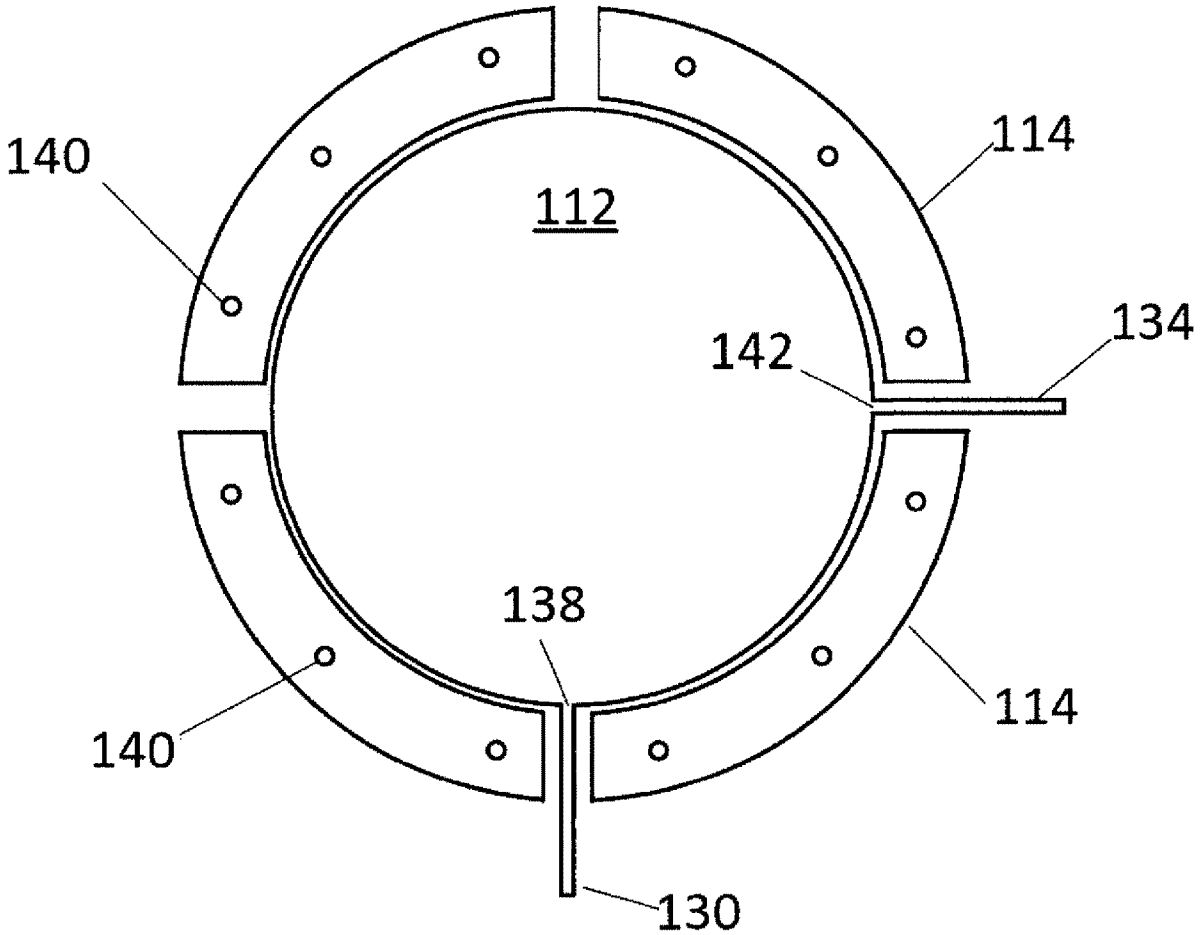
FIG. 2 illustrates a top view of a first radiator patch (lowest radiator patch) placed above a ground plane.

According to some disclosed embodiments, radiator patches 104, 108, and 112 and ground plane 120 have circular geometries. Referring now to FIG. 2, a top view of antenna 100 featuring only one circular radiator patch (radiator patch 112) is shown. Radiator patch 112 is placed above ground plane 120 and is separated from ground plane 120 by dielectric substrate 116C.

In other embodiments, a plurality of loading elements such as arcs 114 may be placed above a ground plane to encircle one of the patches (e.g., patch 112). The loading elements may have any suitable shape (e.g., arc, circular, square, snowflake, etc.), and they may be configured as resonant or non-resonant elements. In some embodiments, the loading elements may reconfigurable and may be comprised of active (e.g., transistors) and/or passive elements.

The arcs 114 may be made from a conductive material (e.g., copper, gold). In some embodiments, arcs 114 may be connected to ground plane 120 through a plurality of vias 140, in which case the overall ground plane may be said to be a composite ground comprised of ground plane 120 and arcs 114 interconnected through vias 140. In other embodiments arcs 114 are not connected to ground plane 120 through vias 114, in which case arcs 114 function as separate elements.

According to disclosed embodiments, radiator patch 112 and ground plane 120 may have approximately equal diameters. In other embodiments, the diameter of ground plane 120 may be larger or smaller than the diameter of radiator patch 112.

Referring to FIG. 2, antenna 100 comprises a plurality of vias 140 formed around radiator patch 112 through the dielectric substrate. Vias 140 are filled with conductive material and are connected to ground plane 120. Vias 140 act as grounded shields, and they may also be used to add capacitive loading to the patch, which may be used to reduce the resonant frequency of the patch for purposes of size reduction.

Figure 3:
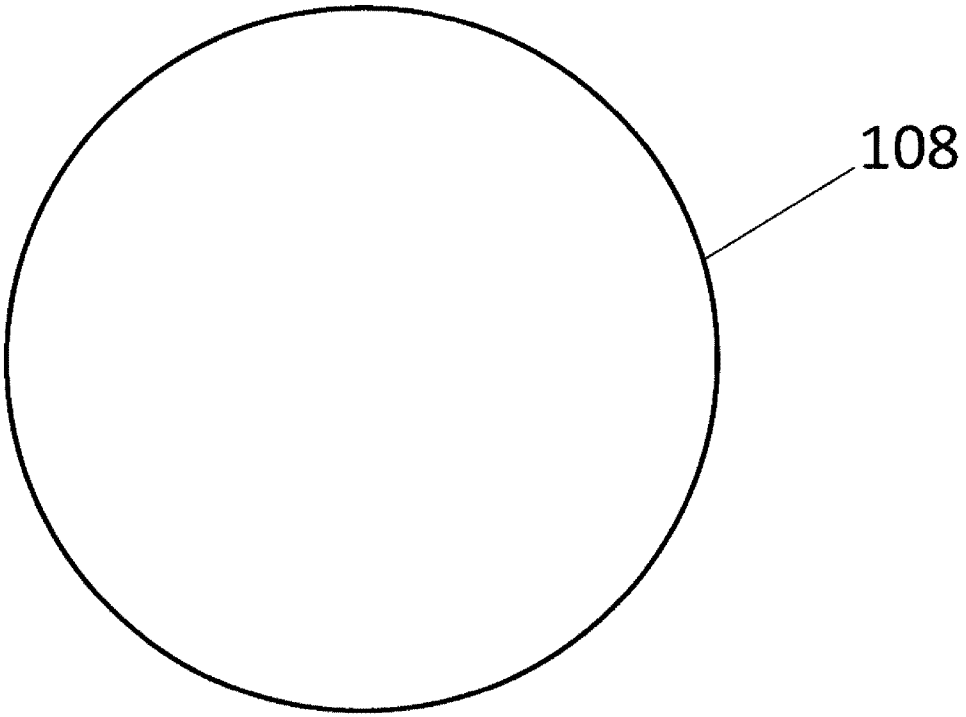
FIG. 3 illustrates a second radiator patch placed above the first radiator patch.
Figure 4:
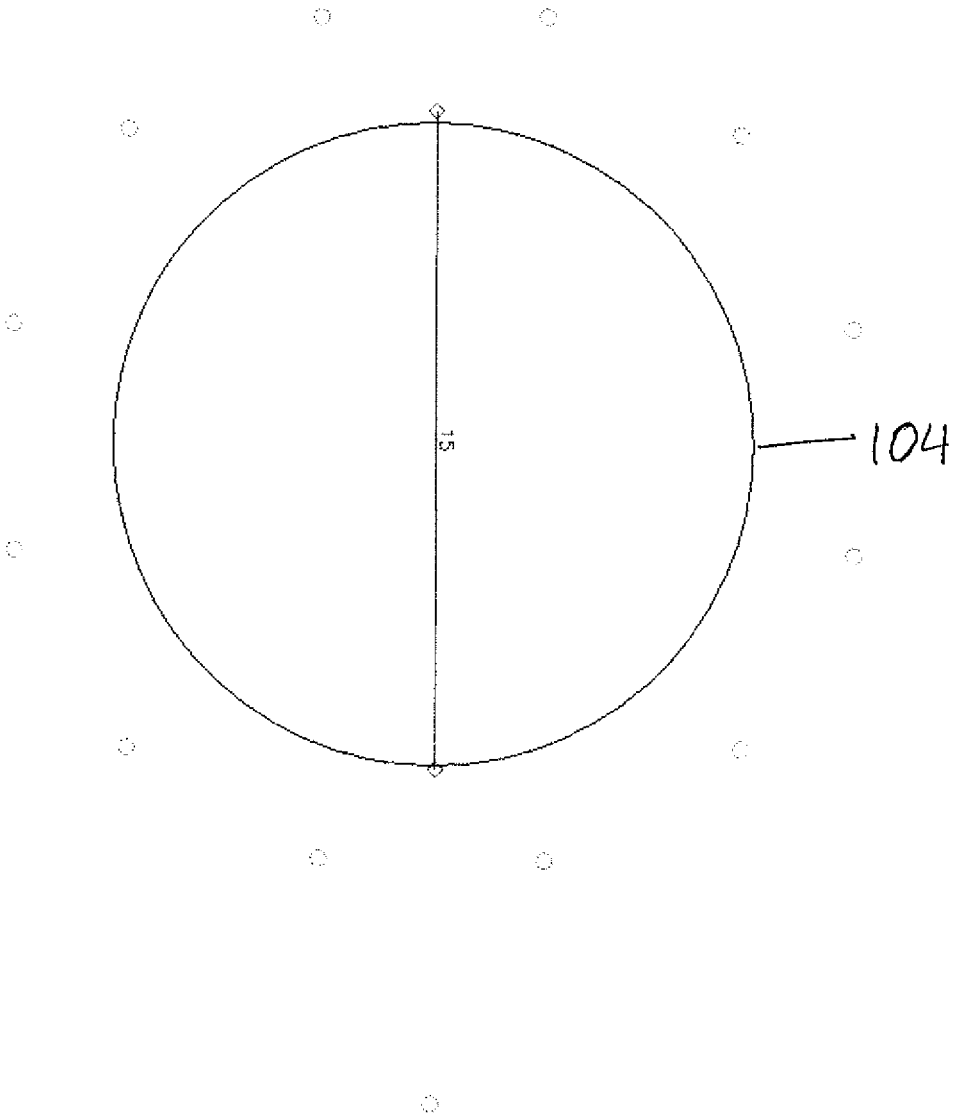
FIG. 4 illustrates a third radiator patch (top radiator patch) placed above the second radiator patch.

FIG. 3 illustrates a second radiator patch (radiator patch 108) which is placed above radiator patch 112. Radiator patch 108 is separated from radiator patch 112 by dielectric substrate 116B. Radiator patch 108 may have dimensions that are same or different than the dimensions of radiator patch 104. FIG. 4 illustrates a third patch (radiator patch 104) which is placed above radiator patch 108. Radiator patch 104 is separated from radiator patch 108 by dielectric substrate 116C. Thus, radiator patches 104, 108, and 112 and ground plane 120 are stacked to form a stacked circular patch antenna. In other embodiments, metalized vias may be used to connect patches 104, 108, and 112 through the dielectric substrate.

Figure 5:
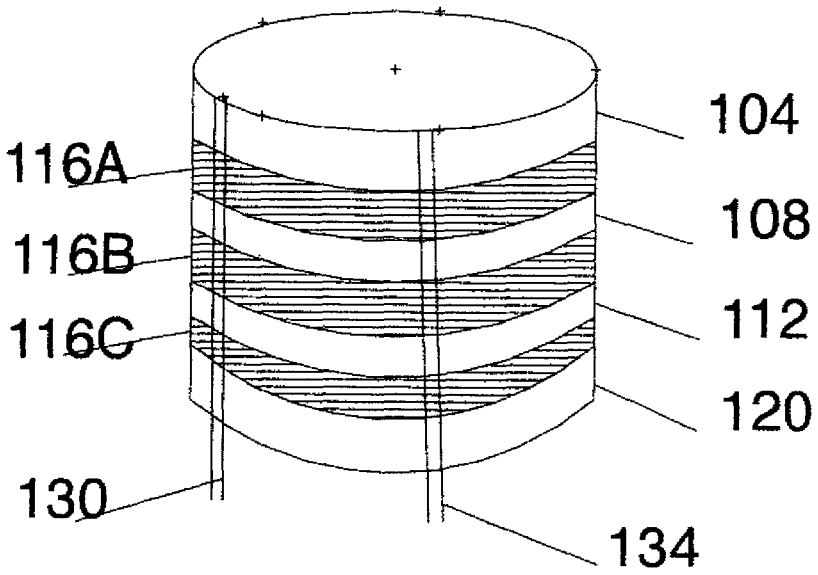
FIG. 5 is a perspective view of an antenna in accordance with disclosed embodiments.

FIG. 5 is a perspective view of antenna 100. Radiator patches 104, 108, and 112 and ground plane 120 are stacked substantially vertically and are separated by the substrates without any air gap. In other embodiments, a via may also be used in addition to the dielectric substrate to connect patches 104, 108, and 112. Thus, no air gap exists between the radiator patches and the ground plane. Feed lines 130 and 134 are electrically connected to radiator patches 104, 108, and 112 and ground plane 120.

According to some embodiments, feed lines 130 and 134 are connected to antenna 100 via input ports 138 and 142, respectively. According to the principles of the invention, a high level of isolation is present between input ports 138 and 142. Thus, antenna 100 can be excited in two separate directions by two different input signals in order to achieve dual polarization. The dual polarized antenna can offer two transmission channels in the same frequency band, which is beneficial in MIMO communications. According to some disclosed embodiments, feed lines 130 and 134 are oriented at a substantially 90 degree angle relative to each other.

According to the principles of the invention, radiator patches 104, 108, and 112 and ground plane 120 may be any geometry. While circular patches (i.e., radiator patches 104, 108, and 112) are conceptually illustrated in FIGS. 2-5, the invention is not limited to such shapes. Other solid or semi-solid Euclidean structures, including ellipse, oval, polygon, semicircle or other shapes may be utilized and are intended to fall within the scope of the invention.

According to some disclosed embodiments, antenna 100 may be configured to transmit downlink signals in the 24-GHz frequency range. Thus, antenna 100 is adapted to operate at higher frequencies where abundant spectrum is available. At millimeter wave frequencies (28 GHz and above), a large number of antennas 100, which have very wide bandwidths and relatively small profile, may be used to provide Gb/s data rates to users. During transmission, antenna 100 is excited by two different input signals having a frequency range of 24-60 GHz via its two input ports in order to achieve dual polarization, and thus offer two transmission channels in the same frequency band.

According to other embodiments, antenna 100 is configured to receive uplink signals in the 5 GHz frequency range. Thus, antenna 100 may receive uplink transmission from mobile devices that operate in a 4G LTE network.

According to some disclosed embodiments, radiator patch 112 is separated from ground plane 120 by dielectric substrate 116A of 20 mils thickness. Radiator patches 108 and 112, which are adjacent, are separated by dielectric substrate 116B of 20 mils thickness. Also, radiator patches 104 and 108, which are adjacent, are separated by dielectric substrate 116A of 20 mils thickness. Thus, according to some disclosed embodiments, adjacent radiator patches are separated by a 20 mils dielectric layer, and the ground plane is separated from an adjacent radiator patch by a 20 mils dielectric layer. However, according to other embodiments, the thickness of dielectric layers between adjacent radiator patches and between the ground plane and the adjacent radiator patch may vary. Additionally, in some embodiments metalized vias may pass through the dielectric layers and intersect the patches.

According to disclosed embodiments, radiator patches 104, 108 and 112 each has a diameter of 1.6 centimeters and a thickness of 0.018 millimeters. In some disclosed embodiments, the radiator patches all have same dimensions, while in other embodiments, their dimensions may vary.

Figure 6:
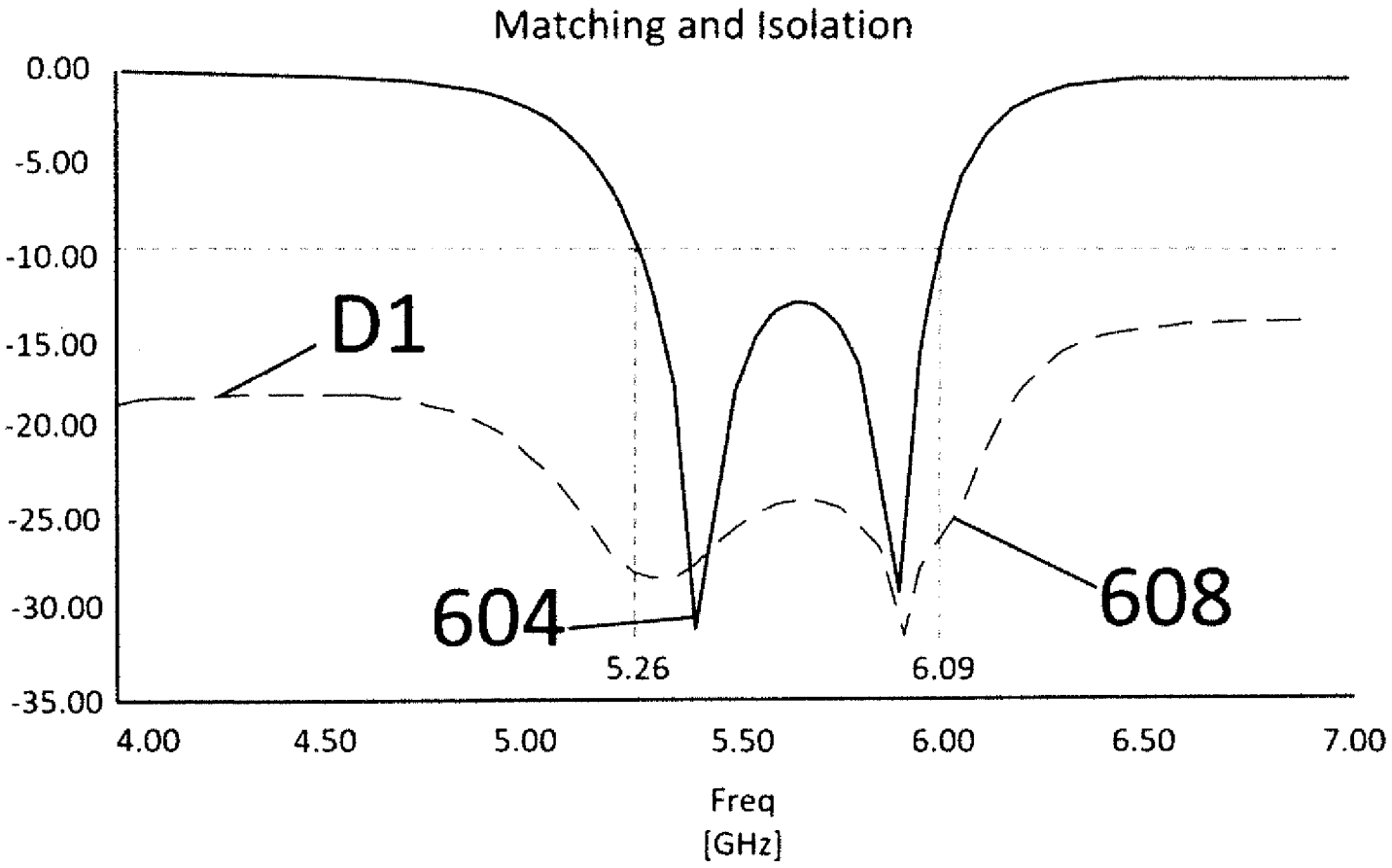
FIG. 6 illustrates the bandwidth of an antenna and isolation between two input ports.

By incorporating multiple radiator patches in antenna 100, a wide half-power bandwidth ranging from 5 to 6 GHz is achieved as shown in FIG. 6. Referring to FIG. 6, two resonances indicated by 604 and 608 are shown and the reflection coefficient is less than −3 dB, thus demonstrating wide bandwidth operation of antenna 100.

It will be appreciated that the stacked patch antenna according to principles of the invention has many advantages over existing dual polarized antennas. In particular, the stacked patch antenna is rugged and easily manufactured on a multi-layer PCB. For example, radiator patches 104, 108, and 112 and ground plane 120 can be printed or etched on separate dielectric substrate layers. The dielectric substrate layers can be joined by laminating or other process. According to some disclosed embodiments, a muli-layer AstraMT77 substrate PCB may be used to manufacture antenna 100.

Unlike conventional dual polarized antennas that generally need air gaps to achieve a wide bandwidth and dual-polarization, antenna 100 does not need air gaps between radiator patches 104, 108, and 112 and ground plane 120. Consequently, antenna 100 is structurally rigid and particularly adapted for outdoor deployment.

Referring again to FIG. 6, isolation between two input ports 138 and 142 of antenna 100 is shown by dotted line D1. A high level of isolation exists between the input ports (below −20 dB over a wide bandwidth) which enables antenna 100 to be excited by two different input signals, thereby exhibiting dual polarization. The dual polarized antenna can offer two transmission channels in the same frequency band.

Figure 7:
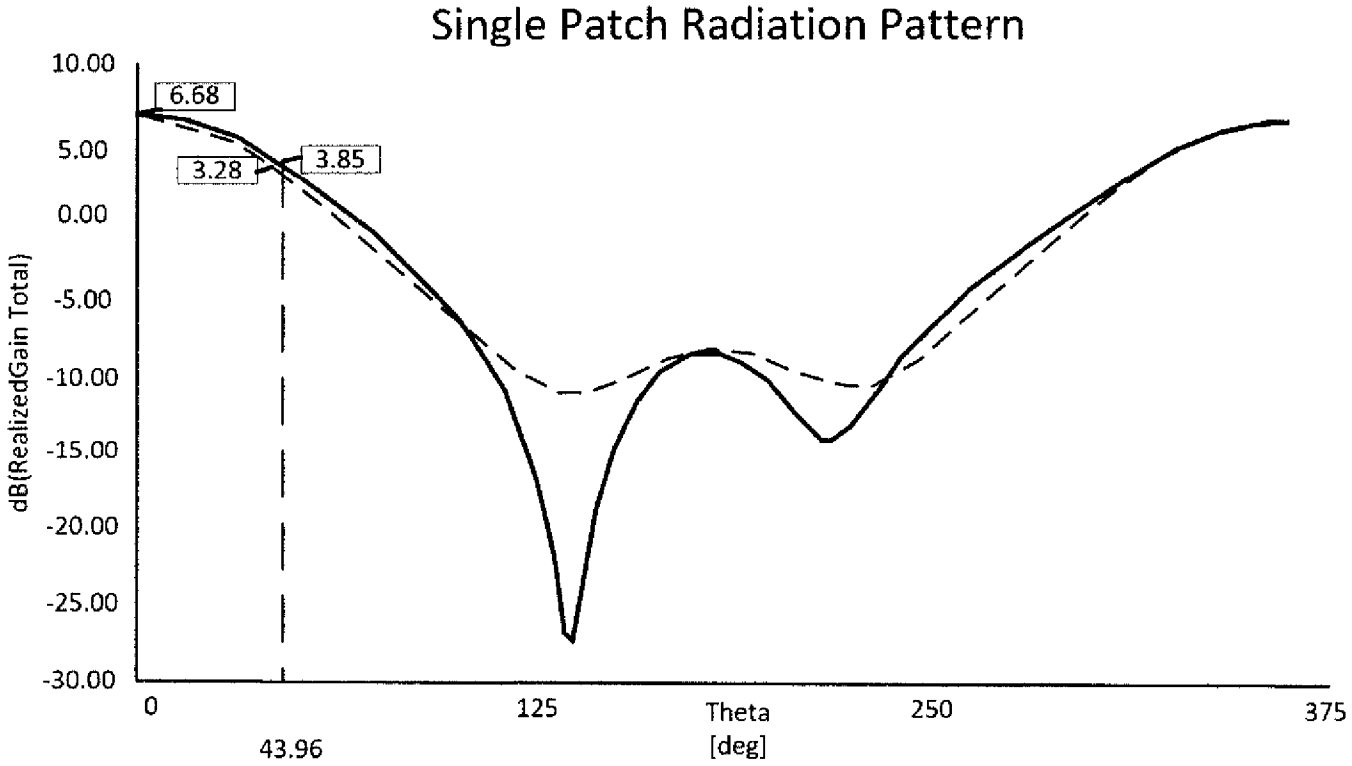
FIG. 7 illustrates the radiation pattern of an antenna in accordance with disclosed embodiments.

FIG. 7 illustrates the radiation pattern of antenna 100 in the azimuth and elevation planes with only one input (either vertical or horizontal) being excited. As shown in FIG. 7, antenna 100 achieves between 6 dB and 7 dB gain.

Figure 8:
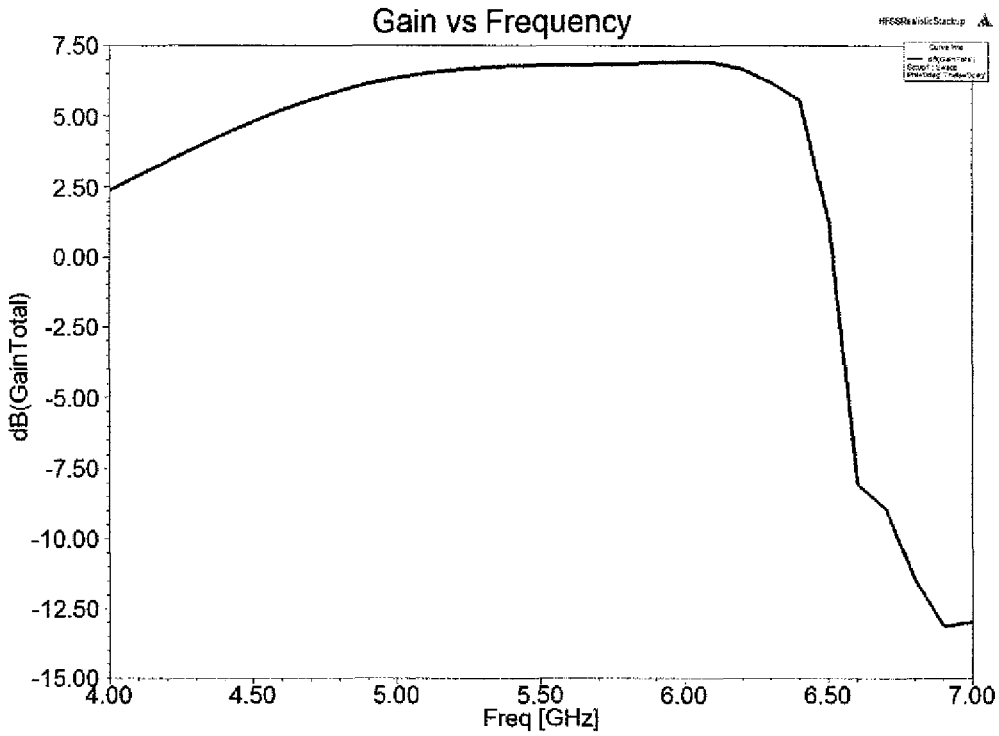
FIG. 8 is a gain vs. frequency plot of an antenna.

FIG. 8 is a gain vs. frequency plot of antenna 100. As shown in FIG. 8, antenna 100 exhibits a gain of approximately 6.68 dBi between 5 GHz and 6.5 GHz, thus exhibiting a high gain over a wide bandwidth.

Figure 9:
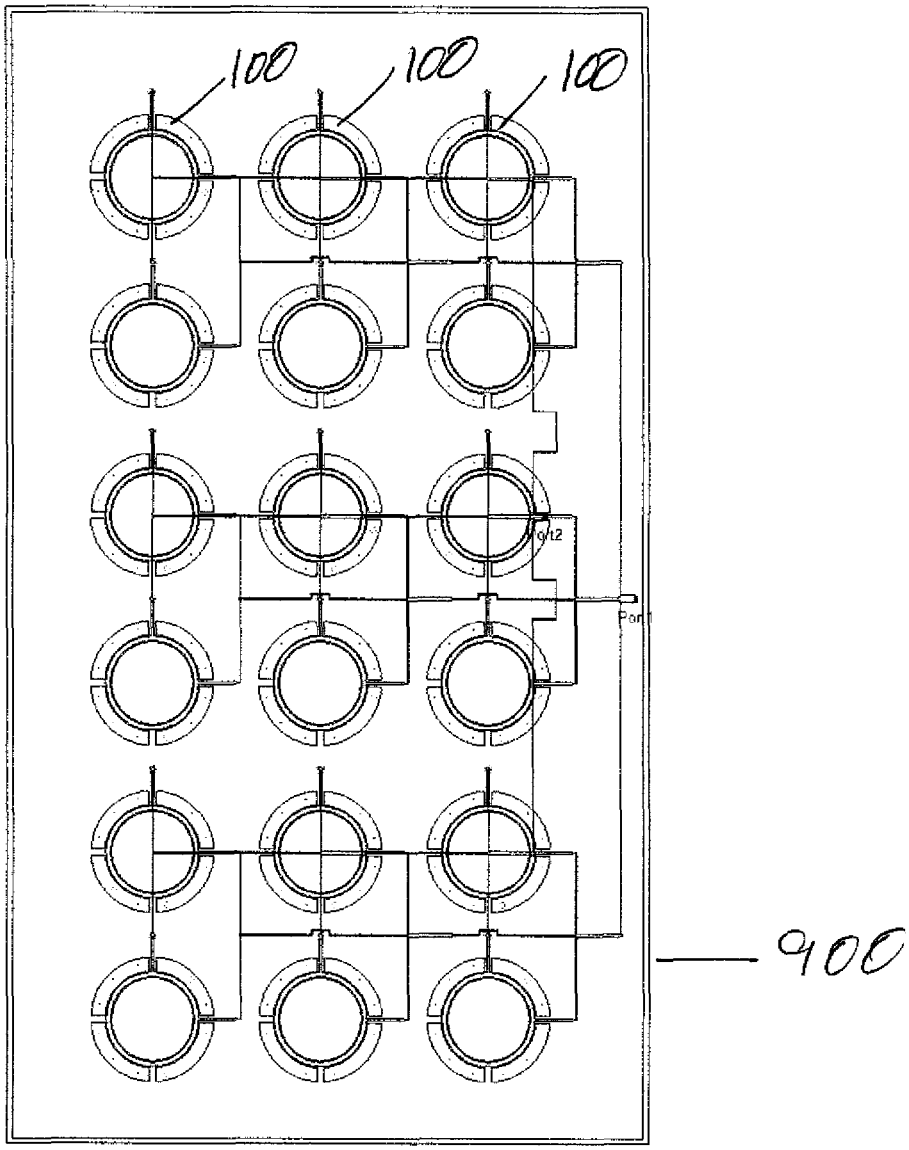
FIG. 9 illustrates an array antenna system in accordance with disclosed embodiments.

According to principles of the invention, multiple antennas 100 are arrayed to form an array antenna system for increased gain. FIG. 9 illustrates array antenna system 900 in accordance with some disclosed embodiments. Array antenna system 900 includes a plurality of antennas 100 arrayed as shown in FIG. 9. According to some disclosed embodiments, 12 antennas are arranged in a 6×3 array.

Figure 10:
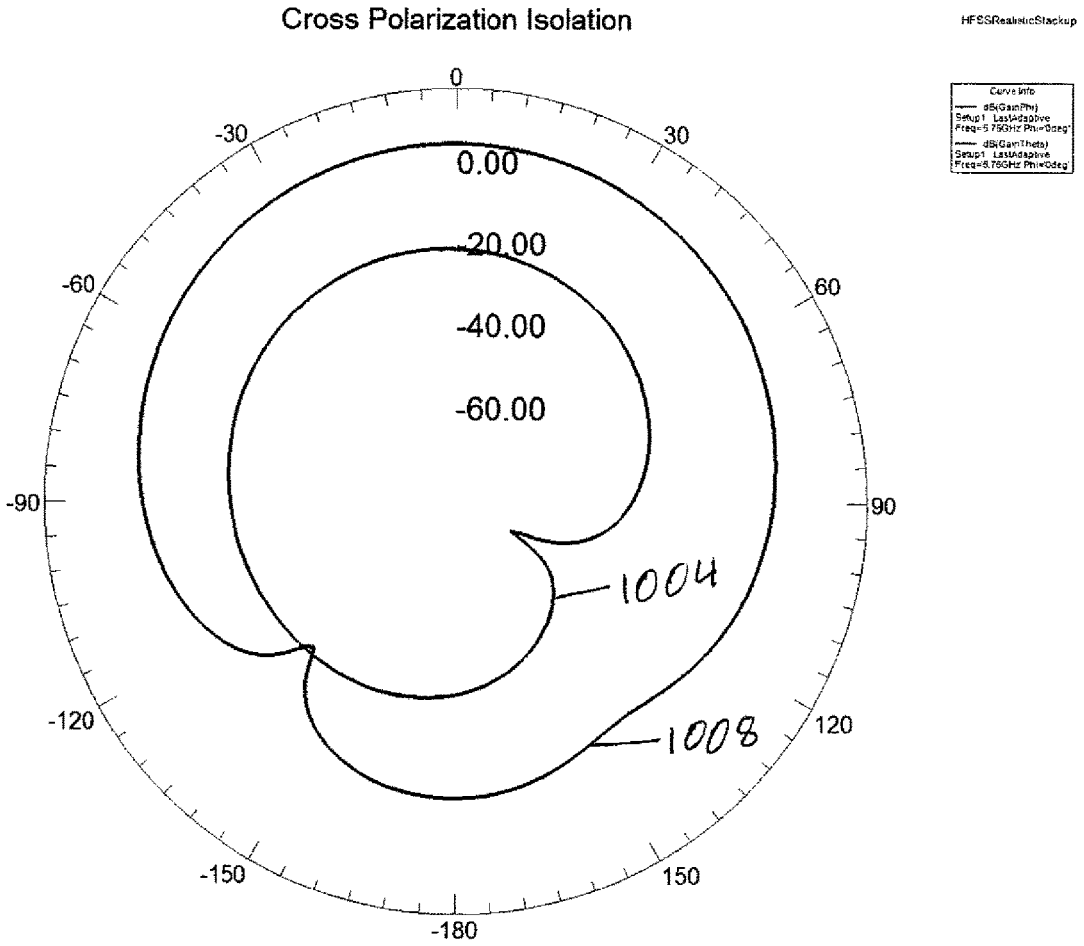
FIG. 10 illustrates the cross polarization isolation of an antenna.

FIG. 10 illustrates the cross-polarization isolation of antenna 100. As shown in FIG. 10, the cross-polarization gain (indicated by 1004) is much lower than the co-polarization gain (indicated by 1008). Since the cross-polarization isolation is high, each input can be independently excited to achieve dual polarization.

Those skilled in the art will recognize that, for simplicity and clarity, the full structure and operation of all systems suitable for use with the present disclosure is not being depicted or described herein. Instead, only so much of systems as is unique to the present disclosure or necessary for an understanding of the present disclosure is depicted and described. The remainder of the construction and operation of the disclosed systems may conform to any of the various current implementations and practices known in the art.

Of course, those of skill in the art will recognize that, unless specifically indicated or required by the sequence of operations, certain steps in the processes described above may be omitted, performed concurrently or sequentially, or performed in a different order. Further, no component, element, or process should be considered essential to any specific claimed embodiment, and each of the components, elements, or processes can be combined in still other embodiments.

Those skilled in the art to which this application relates will appreciate that other and further additions, deletions, substitutions and modifications may be made to the described embodiments.

What is claimed is:

1. A wideband dual-polarized patch antenna comprising:

a ground plane layer;

a first dielectric substrate layer disposed on the ground plane layer;

a first radiator patch disposed on the first dielectric substrate layer;

a second dielectric substrate layer disposed on the first radiator patch;

a second radiator patch disposed on the second dielectric substrate layer;

a third radiator patch disposed on the third dielectric substrate layer;

a plurality of arc-shaped conductive loading elements disposed on at least one of the dielectric substrate layers, the arc-shaped conductive loading elements encircling at least one of the radiator patches and positioned spaced from the radiator patches; and first and second feed lines electrically connected to at least one of the radiator patches and to the ground plane, the first and second feed lines configured to excite the antenna in two separate directions.

2. The wideband dual-polarized patch antenna of claim 1, wherein the radiator patches are comprised of a conductive material, and wherein the radiator patches are not electrically connected to the arc-shaped conductive loading elements.

3. The wideband dual-polarized antenna of claim 1, wherein the ground plane is comprised of a conductive material.

4. The wideband dual-polarized patch antenna of claim 1, wherein the first, second, third radiator patches are stacked substantially vertically above the ground plane.

5. The wideband dual-polarized patch antenna of claim 1, wherein the first, second, third radiator patches and the ground plane are each formed on separate substrates of a multi-layer printed circuit board (PCB), and wherein the substrates are stacked substantially vertically.

6. The wideband dual-polarized patch antenna of claim 1, wherein a multi-layer printed circuit board (PCB) comprises multiple substrates, and wherein the first radiator patch is formed on a first substrate disposed on the ground plane, wherein the second radiator patch is formed on a second substrate disposed on the first radiator patch, and wherein the third radiator patch is disposed on a third substrate disposed on the second radiator patch.

7. The wideband dual-polarized patch antenna of claim 1, wherein the radiator patches are sized to transmit downlink signals in the 24-60 GHz frequency band.

8. The wideband dual-polarized antenna of claim 1, wherein the radiator patches are sized to receive uplink signals in the 5 GHz range frequency band.

9. The wideband dual-polarized antenna of claim 1, wherein the arc-shaped conductive loading elements are connected to the ground plane via metalized vias.

10. A wideband dual-polarized patch antenna comprising:

a multi-layer printed circuit board (PCB) comprising multiple substrates;

a ground plane disposed on a first substrate;

a first radiator patch formed on a second substrate disposed on the ground plane;

a second radiator patch formed on a third substrate disposed on the first radiator patch a third radiator patch formed on a fourth substrate disposed on the second radiator patch;

a plurality of arc-shaped conductive loading elements disposed on at least one of the dielectric substrate layers, the arc-shaped conductive loading elements encircling at least one of the radiator patches and positioned spaced from the radiator patches;

wherein the first, second, third radiator patches and the ground plane are attached to the adjacent substrates without an air gap.

11. The wideband dual-polarized patch antenna of claim 10, wherein the first, second, third radiator patches and the ground plane are separated by the substrates and stacked substantially vertically, and wherein the radiator patches are not electrically connected to the arc-shaped conductive loading elements.

12. The wideband dual-polarized patch antenna of claim 10, wherein no air gap exists between the radiator patches and the ground plane.

13. The wideband dual-polarized patch antenna of claim 10, further comprising first and second feed lines electrically connected to at least one of the radiator patches and to the ground plane, the first and second feed lines configured to excite the antenna in two separate directions to cause orthogonal dual-polarization.

14. The wideband dual-polarized patch antenna of claim 10, wherein the radiator patches are circular with a center and a periphery.

15. The wideband dual-polarized patch antenna of claim 10, wherein the first and second feed lines are spaced at a substantially 90-degree angle relative to one another.

16. An array antenna system, comprising:

a plurality of patch antennas, each patch antenna comprising:

a ground plane layer;

a first dielectric substrate layer disposed on the ground plane layer;

a first radiator patch disposed on the first dielectric substrate layer;

a second dielectric substrate layer disposed on the first radiator patch;

a second radiator patch disposed on the second dielectric substrate layer;

a third dielectric substrate layer disposed on the second radiator patch;

a third radiator patch disposed on the third dielectric substrate layer;

a plurality of arc-shaped conductive loading elements disposed on at least one of the dielectric substrate layers, the arc-shaped conductive loading elements encircling at least one of the radiator patches and positioned spaced from the radiator patches; and first and second feed lines electrically connected to at least one of the radiator patches and to the ground plane, the first and second feed lines configured to excite the antenna in two separate directions.

17. The array antenna system of claim 16, wherein the patch antennas are arrayed in a mXn formation, wherein m and n are integers.

18. The array antenna system of claim 16, wherein the first, second, third radiator patches and the ground plane are each formed on separate substrates of a multi-layer printed circuit board (PCB), and wherein the substrates are stacked substantially vertically.

19. The array antenna system of claim 16, wherein the first, second, third radiator patches and the ground plane are attached to the adjacent substrates of the multi-layer PCB without an air gap, and wherein the radiator patches are not electrically connected to the arc-shaped conductive loading elements.

20. The array antenna system of claim 16, wherein no air gap exists between the radiator patches and the ground plane.

21. The array antenna system of claim 16, wherein the radiator patches are circular with a center and a periphery.

22. The array antenna of claim 16, wherein the first and second feed lines are oriented at substantially 90 degrees angle relative to each other.

23. The array antenna system of claim 16, wherein the radiator patches are sized to transmit downlink signals in the 24-60 GHz frequency band.

24. The array antenna system of claim 16, wherein the radiator patches are sized to receive uplink signals in the 5 GHz range frequency band.

25. The array antenna system of claim 16, wherein the arc-shaped conductive loading elements are connected to the ground plane layer via metalized vias.

* * * * *